US006719857B2

(12) United States Patent
Ohori et al.

(10) Patent No.: US 6,719,857 B2
(45) Date of Patent: Apr. 13, 2004

(54) DIE CASTING MAGNESIUM ALLOY

(75) Inventors: Koichi Ohori, Susono (JP); Yusuke Nakaura, Susono (JP); Takeshi Sakagami, Susono (JP)

(73) Assignee: Mitsubishi Aluminum Co., Ltd., Tokyo (JP)

( * ) Notice: Subject to any disclaimer, the term of this patent is extended or adjusted under 35 U.S.C. 154(b) by 382 days.

(21) Appl. No.: 09/790,684

(22) Filed: Feb. 23, 2001

(65) Prior Publication Data

US 2001/0023720 A1 Sep. 27, 2001

(30) Foreign Application Priority Data

Feb. 24, 2000 (JP) ..... P2000-047661

(51) Int. Cl.[7] ..... C22C 23/02

(52) U.S. Cl. ..... 148/424; 420/407; 420/408; 420/409; 420/410

(58) Field of Search ..... 148/424; 420/407, 420/408, 409, 410

(56) References Cited

U.S. PATENT DOCUMENTS 5,147,603 A 9/1992 Nussbaum et al. ..... 420/409
5,223,215 A 6/1993 Charbonnier et al. ..... 420/407
5,681,403 A 10/1997 Makino et al. ..... 148/420
6,264,763 B1 * 7/2001 Powell et al. ..... 148/420

FOREIGN PATENT DOCUMENTS

| | | |
|---|---|---|
| AU | 725991 | 10/2000 |
| EP | 0 791 662 | 8/1997 |
| EP | 0 799 901 | 10/1997 |
| EP | 1 048 743 | 11/2000 |
| JP | 7-11374 | 1/1995 |
| JP | 8-41576 | 2/1996 |
| JP | 08 041576 | 2/1996 |
| JP | 9-272945 | 10/1997 |
| JP | 9-291332 | 11/1997 |

* cited by examiner

*Primary Examiner*—Sikyin Ip
(74) *Attorney, Agent, or Firm*—Oblon, Spivak, McClelland, Maier & Neustadt, P.C.

(57) ABSTRACT

The present invention provides a die casting magnesium alloy having excellent heat resistance and castability, and the alloy of the present invention is a die casting magnesium alloy having excellent heat resistance and castability, comprising 2 to 6% by weight of Al, 0.3 to 2% by weight of Ca, 0.01 to 1% by weight of Sr, 0.1 to 1% by weight of Mn, the balance magnesium and unavoidable impurities. According to the present invention, more excellent effects can be obtained in the composition wherein rare earth elements are added to the composition described above.

4 Claims, 3 Drawing Sheets

DIE CASTING MAGNESIUM ALLOY

FIELD OF THE INVENTION

The present invention relates to a die casting magnesium alloy having excellent heat resistance and castability.

BACKGROUND OF THE INVENTION

For the purpose of weight saving, magnesium alloys have recently become of major interest in modes of transport, including automobiles.

As these magnesium alloys, particularly casting magnesium alloys, for example, Mg—Al alloys containing 2 to 6% by weight of Al (e.g. AM60B, AM50A, or AM20A defined in ASTM [American Society for Testing and Materials] standard) or Mg—Al—Zn alloys containing 8 to 10% by weight of Al and 1 to 3% by weight of Zn (e.g. AZ91D defined in ASTM standard) have been known. These magnesium alloys have good castability and can be applied to die casting.

However, in case such a magnesium alloy is used for parts for the proximity of an engine, the magnesium alloy is liable to cause yielding during use because of low creep strength at high temperature ranging from 125 to 175° C., e.g. 150° C., thus loosening bolts by which parts are clamped.

For example, typical die casting alloy AZ91D has poor creep strength, although it has good castability, tensile strength and corrosion resistance.

AE42 is known as a heat-resistant die casting alloy containing rare earth metals, but this alloy does not have good castability and also has poor creep strength.

Therefore, there have recently been suggested alloys wherein Ca is added to a Mg—Al alloy (Japanese Patent Application, First Publication No. Hei 7-11374 and Japanese Patent Application, First Publication No. Hei 9-291332).

However, these Mg—Al—Ca alloys have poor creep strength as compared with an aluminum alloy ADC12 (Al-1.5–3.5Cu-9.6–12.0 Si; corresponding to AA A384.0), although the creep strength is improved. Furthermore, these Mg—Al—Ca alloys have a problem that misrun and casting cracks are caused by deterioration of the die-castability. Although these alloys contain rare earth elements as essential components, the cost increases when rare earth elements are added in a large amount.

A thixocasting technique has recently been started to be applied to casting of magnesium alloys, unlike the die casting technique described above. This technique is considered to be effective to inhibit the occurrence of casting crack of the Mg—Al—Ca alloys because it is a method of performing injection molding in a semi-solid state.

However, this technique has never been completed and is not applied to automobile parts at present. Therefore, the die casting technique is still used exclusively as a method of casting Mg alloys.

As disclosed in Japanese Patent Application, First Publication No. Hei4-231435 (U.S. Pat. No. 5,147,603), the application relating to a magnesium alloy having a load at tensile rupture of at least 290 MPa and an elongation at tensile rupture of at least 5%, essentially consisting of 2 to 11% by weight of Al, 0 to 1% by weight of Mn, 0.1 to 6% by weight of Sr, the balance Mg, and less than 0.6% by weight of Si, less than 0.2% by weight of Cu, less than 0.1% by weight of Fe and less than 0.01% by weight of Ni as principal impurities has already been filed.

The magnesium alloys of this patent application are alloys having high mechanical strength and excellent corrosion resistance produced by a rapid solidification method, and is produced in the form of band, powder or tip from a molten alloy by a roller quenching, spraying or atomization method. The patent described above discloses a technique of obtaining a product having a desired shape by consolidating the resulting band, powder or tip to form a billet, and subjecting the billet to conventional extrusion or hydrostatic extrusion.

The alloy of the above patent application is an alloy produced by the rapid solidification process and has very high load at tensile rupture of 290 MPa or more, but this alloy is an alloy obtained only as a solid in the form of band, powder or tip by the rapid solidification process. In order to be formed into a desired shape of the product, alloy powders or alloy granules in the form of bands, powder or tips obtained by the rapid solidification process must be compacted by a heat consolidation molding method such as conventional extrusion or hydrostatic extrusion. Furthermore, finally obtainable shapes are limited.

An object to be attained by the present invention is to provide a die casting magnesium alloy which has excellent heat resistance and castability and also has excellent creep properties.

Another object to be attained by the present invention is to provide a die casting magnesium alloy which has the excellent properties described above and can be formed into a free shape by casting and can also be provided at low cost.

Still another object to be attained by the present invention is to provide a die casting magnesium alloy which is suited to the production of parts having a complicated shape around the engine or thin-wall parts and has excellent heat resistance and castability, and also has excellent creep properties.

SUMMARY OF THE INVENTION

As a result of an intensive study of the influence of additional elements on the castability and the creep strength of Mg—Al—Ca alloys containing Ca, the present inventors have found that the die-castability deteriorated by the addition of Ca can be remarkably improved and the creep strength can be further improved by adding Sr, thus completing the present invention.

The present invention has been attained based on such knowledge, and the objects described above can be attained by die casting magnesium alloys having excellent heat resistance and castability, comprising:

2 to 6% by weight (hereinafter "to" indicates a numerical limitation range including an upper limit and a lower limit unless otherwise specified, and "2 to 6% by weight" represents the range of not less than 2% by weight and not more than 6% by weight) of Al, 0.3 to 2% by weight of Ca, 0.01 to 1% by weight of Sr, 0.1 to 1% by weight of Mn, the balance magnesium and unavoidable impurities.

The Al content was limited to "2 to 6% by weight" based on the results of the test described below.

When the Al content is not more than 6% by weight, a great portion of Al is incorporated into the matrix of Mg in the solid state. The tensile strength of the alloy is enhanced by solid-solution hardening. Also, the creep properties of the alloy are improved by the network-like structure of an Al—Ca compound crystallized out at grain boundary as a result of bonding with Ca. Al also improves the castability of the alloy.

However, when the Al content exceeds 6% by weight, the creep properties rapidly deteriorate. On the contrary, when the Al content is less than 2% by weight, the above effects (effect of improving the tensile strength of the alloy by solid-solution hardening, effect of improving the creep properties) are poor. Particularly, when the Al content is less than 2% by weight, the resulting alloy is liable to have low strength and poor practicability.

In light of the background described above, the Al content was set within a range from 2 to 6% by weight. The Al content is preferably within a range from 4.0 exclusive to 6% by weight, within the above range.

And the creep properties is improved with the increase of the Ca content. When the Ca content is less than 0.3% by weight, the improvement effect is small. However, when the Ca content exceeds 2% by weight, the casting crack is liable to occur.

In light of the background described above, the Ca content was set within a range from 0.3 to 2%by weight. The Ca content is preferably within a range from 0.5 to 1.5% by weight, within the above range.

Further the creep properties improved with the increase of the Sr content and it becomes hard to cause casting crack. This effect is small when the Sr content is less than 0.01% by weight. On the other hand, when the Sr content exceeds 1% by weight, the effect reaches the saturated state.

In the present invention, the Sr content was set within a range from 0.01 to 1% by weight. Under the circumstances described above, the Sr content is preferably within a range from 0.05 to 0.5% by weight, and more preferably within a range from 0.15 exclusive to 0.4% by weight, within the range described above.

In case Mn is added to this kind of an alloy, the corrosion resistance is improved and the creep strength is also improved. Furthermore, the proof stress, particularly high temperature proof stress is improved.

This effect is small when the Mn content is less than 0.1% by weight. However, when the Mn content exceeds 1% by weight, a large mount of a primary elemental Mn particle is crystallized. Therefore, the resulting alloy becomes brittle, thereby lowering the tensile strength.

For the reasons described above, the Mn content was set within a range from 0.1 to 1% by weight. The Mn content is more preferably within a range from 0.2 to 0.7% by weight.

The essential element in the Mg alloy of the present invention includes Al, Ca, Sr and Mn, in addition to Mg. The other elements are basically contained as unavoidable impurities.

However, when Si, Zn, and rare earth elements are contained in the proportion described below, the following advantages are also obtained.

Sometimes, the die casting magnesium alloy of the present invention further contains 0.1 to 1% by weight (preferably 0.2 to 0.6% by weight) of Si, in addition to the components described above. Sometimes, the die casting magnesium alloy further contains 0.2 to 1% by weight (preferably 0.4 to 0.8% by weight) of Zn, in addition to the components described above. Sometimes, the die casting magnesium alloy further contains 0.1 to 3% by weight (preferably 0.5 to 2.0% by weight, more preferably 0.8 to 1.5% by weight) of rare earth elements, in addition to the components described above.

Regarding the die casting magnesium alloy further containing Si in the proportion described above, it is made possible to obtain the advantage that the castability is further improved, thereby making it difficult to cause casting crack.

Regarding the die casting magnesium alloy further containing Zn in the proportion described above, it is made possible to obtain the advantage that the tensile strength is improved by solid-solution hardening.

Regarding the die casting magnesium alloy further containing rare earth elements in the proportion described above, it is made possible to obtain the advantage that the creep strength are further improved. Concretely, the alloy containing rare earth elements contains 2 to 6% by weight of Al, 0.3 to 2% by weight of Ca, 0.01 to 1% by weight of Sr, 0.1 to 1% by weight of Mn, 0.1 to 3% by weight of rare earth elements (one or more kinds of La, Ce, Pr, Nd, Pm, Sm, Eu, Gd, Tb, Dy, Ho, Er, Tm, Yb and Lu), the balance Mg and unavoidable impurities. When the content of rare earth elements exceeds 3% by weight, casting crack increases and die-sticking becomes severe, thereby deteriorating the castability. Also, coarsening of the Al—RE compound in the constitution occurs, thereby deteriorating the mechanical properties. Furthermore, since rare earth elements are expensive elements, the smaller the amount, the better, in view of the cost.

The die casting magnesium alloy of the present invention such as Mg—Al—Ca-Mn-Sr alloy is produced by a general technique of melting the Mg alloy. For example, the alloy can be obtained by melting in an iron crucible using a protective gas such as $SF_6/CO_2$/Air.

The die casting magnesium alloy of the present invention has excellent mechanical properties such as tensile strength, proof stress, elongation, and the like and has excellent castability free from die-sticking during the casting, and also has excellent creep properties and corrosion resistance which are markedly excellent features for die casting magnesium alloys. According to the magnesium alloy of the present invention, it is made possible to obtain an excellent casting made of magnesium alloy, which is free from cracking and defects, even in case when thin-wall cast parts are produced.

The die casting magnesium alloy of the present invention is markedly preferred as an alloy to produce by die casting parts for the proximity of an engine, and can provide an excellent die casting product.

DESCRIPTION OF PREFERRED EMBODIMENTS

The die casting magnesium alloy with the present invention can be applied to automobile parts around the engine, for example, structural members around an engine, such as cylinder blocks, cylinder heads, cylinder head covers, oil pans, oil pump bodies, oil pump covers, and intake manifolds; and cases, for example, case members around an engine, such as transmission cases, transfer cases, chain case stealing cases, joint covers, and oil pump covers.

The Al content was limited to "2 to 6% by weight" based on the results of the test described below.

When the Al content is not more than 6% by weight, a great portion of Al is incorporated into the matrix of Mg in the solid state. The tesile strength of the alloy is enhanced by solid-solution hardening. Also, the creep properties of the alloy are improved by the network-like structure of an Al—Ca compound crystallized out at grain boundary as a result of bonding with Ca. Al also improves the castability of the alloy.

However, when the Al content exceeds 6% by weight, the creep properties rapidly deteriorate. On the contrary, when the Al content is less than 2% by weight, the above effects (effect of improving the tensile strength of the alloy by solid-solution hardening, effect of improving the creep properties) are poor. Particularly, when the Al content is less than 2% by weight, the resulting alloy is liable to have low strength and poor practicability.

In light of the background described above, the Al content was set within a range from 2 to 6% by weight. The Al content is preferably within a range from 4.0 exclusive to 6% by weight, within the above range.

The reason why the Ca content was limited within a range from 0.3 to 2% by weight in the embodiments is as follows.

Figure 1:
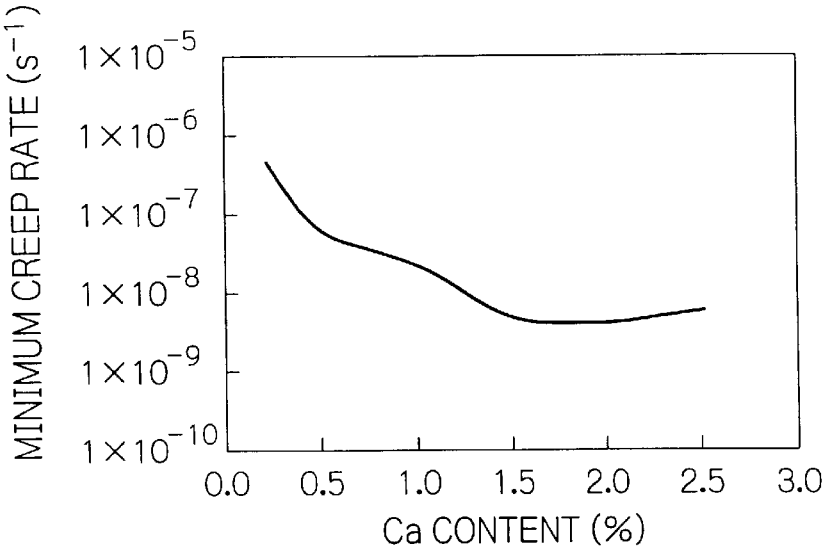
FIG. 1 is a graph showing the relationship between the Ca content and the minimum creep rate.
Figure 2:
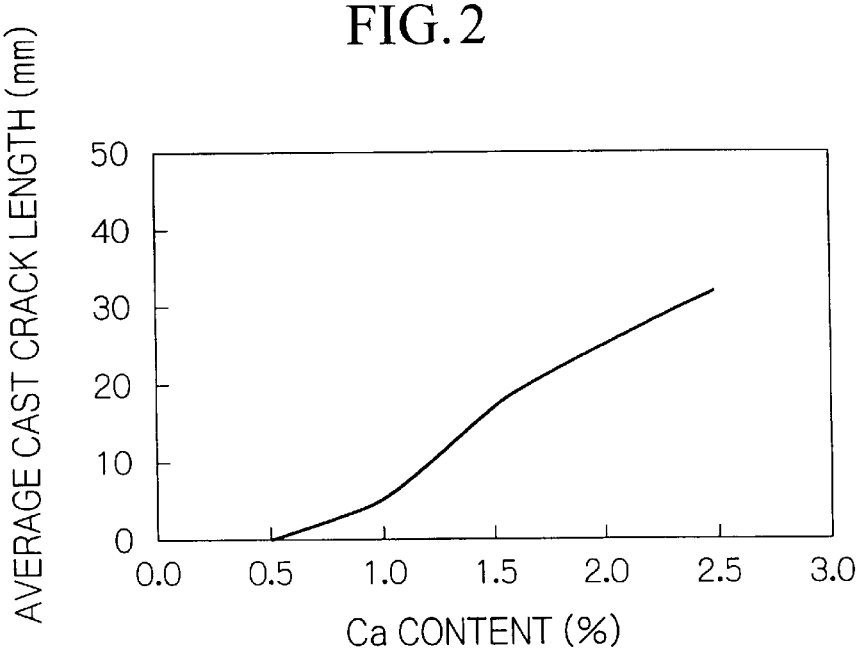
FIG. 2 is a graph showing the relationship between the Ca content and the average casting crack length.

FIG. 1 is a graph showing an influence of the Ca content exerted on the minimum creep rate of the Mg alloy in case the Al content is 5% by weight, and FIG. 2 is a graph showing an influence of the Ca content exerted on the average casting crack length of the Mg alloy in case the Al content is 5% by weight.

As is apparent from FIG. 1, the minimum creep rate decreases with the increase of the Ca content. When the Ca content is less than 0.3% by weight, the improvement effect is small. However, when the Ca content exceeds 2% by weight, the improvement effect is saturated and casting crack is liable to occur as shown in FIG. 2.

In light of the background described above, the Ca content was set within a range from 0.3 to 2% by weight. The Ca content is preferably within a range from 0.5 to 1.5% by weight, within the above range.

The reason why the Sr content was limited within a range from 0.01 to 1% by weight in the embodiments is as follows.

Figure 3:
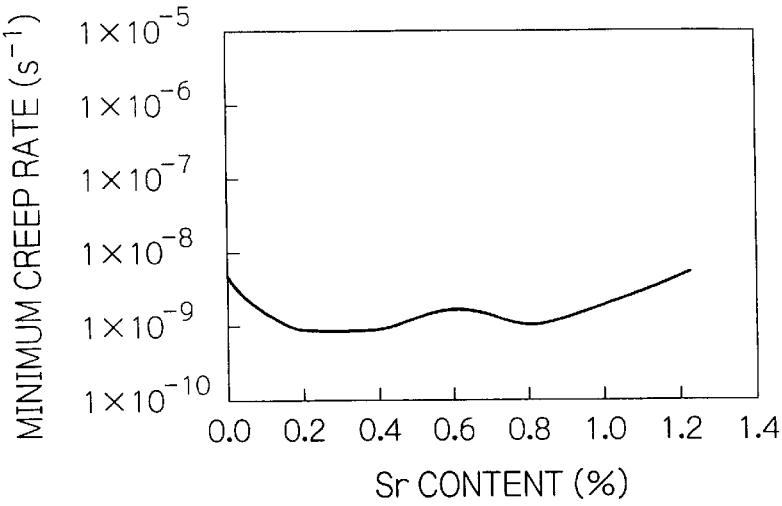
FIG. 3 is a graph showing the relationship between the Sr content and the minimum creep rate.
Figure 4:
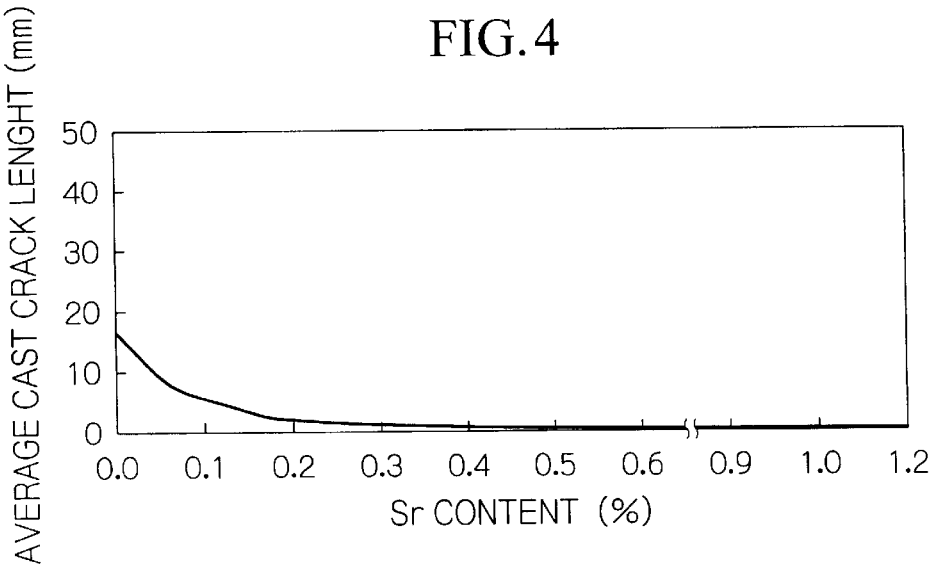
FIG. 4 is a graph showing the relationship between the Sr content and the average casting crack length.

FIG. 3 is a graph showing an influence of the Sr content exerted on the minimum creep rate of the Mg alloy in case the Al content is 5% by weight and the Ca content is 1.5% by weight, and FIG. 4 is a graph showing an influence of the Sr content exerted on the average casting crack length of the Mg alloy in case the Al content is 5% by weight and the Ca content is 1.5% by weight.

As is apparent from FIG. 3 and FIG. 4, the minimum creep rate tends to decrease with the increase of the Sr content and it becomes hard to cause casting crack. This effect is small when the Sr content is less than 0.01% by weight. On the other hand, when the Sr content exceeds 1% by weight, the effect reaches the saturated state. As is apparent from the decrease of the creep rate shown in FIG. 3, low creep rate is maintained within a range from 0.1 to 0.5% by weight and a slight increase is observed within a higher content. Referring to FIG. 4, when the Sr content slightly increases within a range of not more than 0.1% by weight, the casting crack length rapidly decreases and a rapid decrease continues up to about 0.05% by weight. On the other hand, when the Sr content exceeds 0.05% by weight, the average casting crack length is certainly under 10 mm. When the Sr content exceeds 0.1% by weight, the casting crack length decreases to a sufficiently small value, although the decrease proportion of the casting crack length slightly reduces. When the Sr content exceeds 0.2% by weight, the casting crack length decreases to a degree which does not matter in practical use.

In light of the background described above, the Sr content was set within a range from 0.01 to 1% by weight in the present invention. Under the circumstances described above, the Sr content is preferably within a range from 0.15 exclusive to 0.4% by weight, within the above range.

In case Mn is added to the compound to this kind of an alloy, the corrosion resistance is improved and the creep properties is also improved. Furthermore, the proof stress, particularly high temperature proof stress, is improved.

This effect is small when the Mn content is less than 0.1% by weight. However, when the Mn content exceeds 1% by weight, a large amount of a primary elemental Mn particle is crystallized. Therefore, the resulting alloy becomes brittle, thereby lowering the tensile strength.

For the reasons described above, the Mn content was set within a range from 0.1 to 1% by weight. The Mn content is more preferably within a range from 0.2 to 0.7% by weight.

The essential elements in the Mg alloy of the present invention include Al, Ca, Sr, and Mn, in addition to Mg. The other elements are basically contained as unavoidable impurities.

However, when Si, Zn, and rare earth elements are contained in the proportions described below, the following advantages are obtained.

Sometimes, the die casting magnesium alloy of the present invention further contains 0.1 to 1% by weight (preferably 0.2 to 0.6% by weight) of Si, in addition to the components described above. Sometimes, the die casting magnesium alloy further contains 0.2 to 1% by weight (preferably 0.4 to 0.8% by weight) of Zn, in addition to the components described above. Sometimes, the die casting magnesium alloy further contains 0.1 to 3% by weight (preferably 0.5 to 2.0% by weight, more preferably 0.8 to 1.5% by weight) of rare earth elements, in addition to the components described above.

Regarding the die casting magnesium alloy further containing Si in the proportion described above, it is made possible to obtain the advantage that the castability is further improved, thereby making it difficult to cause casting crack.

Regarding the die casting magnesium alloy further containing Zn in the proportion described above, it is made possible to obtain the advantage that the tensile strength is improved by solid-solution hardening.

Regarding the die casting magnesium alloy further containing rare earth elements in the proportion described above, it is made possible to obtain the advantage that the creep properties are further improved. Concretely, the alloys containing rare earth elements contain 2 to 6% by weight of Al, 0.3 to 2% by weight of Ca, 0.01 to 1% by weight of Sr, 0.1 to 1.0% by weight of Mn, 0.1 to 3% by weight of rare earth elements (one or more kinds of La, Ce, Pr, Nd, Pm, Sm, Eu, Gd, Tb, Dy, Ho, Er, Tm, Yb and Lu), the balance being Mg and unavoidable impurities. When the content of rare earth elements exceeds 3% by weight, casting crack increases and die-sticking to the die becomes severe, thereby deteriorating the castability. Also, coarsening of the Al—RE compound in the constitution occurs, thereby deteriorating the mechanical properties. Furthermore, since rare earth elements are expensive elements, the smaller the amount, the better, in view of the cost.

The die casting magnesium alloy of the present invention such as Mg—Al—Ca—Mn—Sr alloy is produced by a general technique of melting the Mg alloy. For example, the alloy can be obtained by melting in an iron crucible, using a protective gas such as $SF_6/CO_2$/Air.

The present invention will be described by way of more specific embodiments, but the present invention is not limited by the following embodiments.

Mg alloys with the composition show in Table 1 and Table 2 below were melted in an iron crucible using an electric furnace under an atmosphere of a mixed gas of $SF_6/CO_2$/Air to form a molten alloy, followed by casting using a cold chamber die casting machine to obtain a casting 1 having the shape show in FIG. 5(*a*) and FIG. 5(*b*).

Figure 5A:
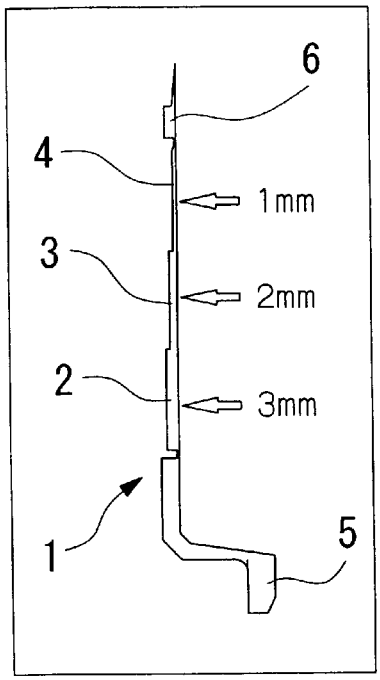
FIG. 5 is schematic view showing a casting obtained in the embodiment, in which FIG. 5(*a*) is a side view of the casting and FIG. 5(*b*) is a plan view of the casting.
Figure 5B:
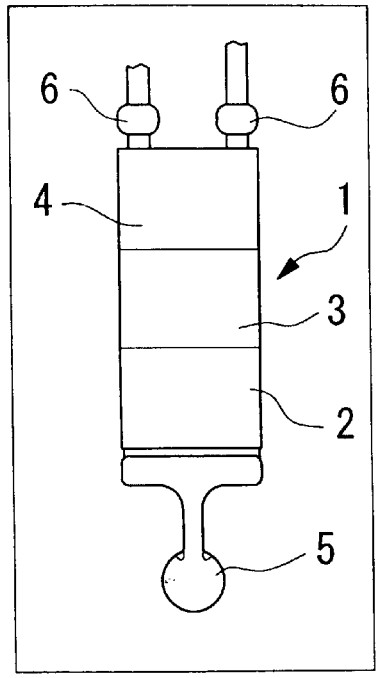

The casting 1 shown in FIG. 5(*a*) and FIG. 5(*b*) is a plate material generally having a width of 70 mm and a height of 150 mm, and a one-third portion of this plate material is a first portion 1 having a thickness of 3 mm, another one-third portion thereof is a second portion 3 having a thickness of 2 mm, and still another one-third portion thereof is a third portion 4 having a thickness of 1 mm. The first portion having a thickness of 3 mm is arranged at the side of a biscuit portion 5, which is the side where a molten metal is poured into a die, followed by continuous formation of the second portion 3 having a thickness of 2 mm and the third portion 4 having a thickness of 1 mm and further formation of an overflow portion 6 where the poured metal overflows at the tip end of the third portion 4.

Rare earth elements were added to the molten metal in the form of a misch metal (52.8% Ce, 27.4% La, 15% Nd, 4.7% Pr and 0.1% Sm).

During the casting, the die-castability was evaluated by the presence or absence of the occurrence of casting crack (hot cracking) and die-sticking.

TABLE 1

| | Composition of alloy (% by weight) | | | | | | | |
|---|---|---|---|---|---|---|---|---|
| | Al | Ca | Sr | Mn | Si | Zn | Rare earth elements | Mg |
| Embodiment 1 | 3.0 | 1.0 | 0.1 | 0.3 | — | — | — | balance |
| Embodiment 2 | 4.0 | 1.0 | 0.1 | 0.3 | — | — | — | balance |
| Embodiment 3 | 5.0 | 1.0 | 0.1 | 0.5 | — | — | — | balance |
| Embodiment 4 | 5.0 | 0.5 | 0.2 | 0.3 | — | — | — | balance |
| Embodiment 5 | 5.0 | 1.5 | 0.3 | 0.3 | — | — | — | balance |
| Embodiment 5 | 5.0 | 1.0 | 0.1 | 0.2 | — | — | — | balance |
| Embodiment 7 | 5.0 | 1.5 | 0.2 | 0.1 | — | — | — | balance |
| Embodiment 8 | 5.5 | 1.0 | 0.1 | 0.4 | — | — | — | balance |
| Embodiment 9 | 5.0 | 1.0 | 0.1 | 0.3 | 0.6 | — | — | balance |
| Embodiment 10 | 5.0 | 1.0 | 0.1 | 0.3 | — | 0.6 | — | balance |
| Embodiment 11 | 3.0 | 0.3 | 0.1 | 0.3 | — | — | — | balance |
| Embodiment 12 | 3.0 | 2.0 | 0.1 | 0.3 | — | — | — | balance |
| Embodiment 13 | 5.0 | 0.3 | 0.1 | 0.3 | 0.6 | — | — | balance |
| Embodiment 14 | 5.0 | 0.3 | 0.1 | 0.3 | — | 0.6 | — | balance |
| Embodiment 15 | 5.0 | 2.0 | 0.1 | 0.3 | 0.6 | — | — | balance |
| Embodiment 16 | 5.0 | 2.0 | 0.1 | 0.3 | — | 0.6 | — | balance |
| Embodiment 17 | 5.0 | 1.0 | 0.1 | 0.3 | 0.2 | 0.4 | 0.2 | balance |
| Embodiment 18 | 5.0 | 1.5 | 0.2 | 0.3 | — | — | 1.0 | balance |
| Embodiment 19 | 5.0 | 1.5 | 0.2 | 0.3 | — | — | 2.5 | balance |
| Embodiment 20 | 5.0 | 1.5 | 0.2 | 0.3 | 0.2 | — | 0.1 | balance |
| Embodiment 21 | 5.0 | 1.5 | 0.2 | 0.3 | 0.2 | — | 2.8 | balance |
| Embodiment 22 | 5.0 | 1.5 | 0.2 | 0.3 | 0.2 | 0.4 | 0.1 | balance |
| Embodiment 23 | 5.0 | 1.5 | 0.2 | 0.3 | 0.2 | 0.4 | 2.9 | balance |
| Embodiment 24 | 5.0 | 0.8 | 0.6 | 0.3 | — | — | — | balance |
| Embodiment 25 | 5.0 | 0.8 | 0.8 | 0.3 | — | — | — | balance |
| Embodiment 26 | 5.9 | 0.5 | 0.1 | 0.3 | — | — | 1.0 | balance |
| Embodiment 27 | 5.0 | 2.0 | 0.1 | 0.9 | — | — | 1.5 | balance |
| Embodiment 28 | 5.0 | 1.5 | 0.8 | 0.3 | — | — | 1.0 | balance |
| Embodiment 29 | 5.0 | 1.5 | 1.0 | 0.3 | — | — | — | balance |
| Embodiment 30 | 5.0 | 1.5 | 0.2 | 0.2 | — | — | 1.4 | balance |
| Embodiment 31 | 5.0 | 1.4 | 0.1 | 0.2 | — | — | 1.9 | balance |
| Embodiment 32 | 5.0 | 1.5 | 0.4 | 0.4 | — | — | — | balance |
| Embodiment 33 | 4.2 | 1.0 | 0.4 | 0.2 | — | — | 1.0 | Balance |

TABLE 2

| | Composition of alloy (% by weight) | | | | | | | |
|---|---|---|---|---|---|---|---|---|
| | Al | Ca | Sr | Mn | Si | Zn | Rare earth elements | Mg |
| Comp. Embodiment 1 | *1.0 | 1.5 | 0.1 | 0.3 | — | — | — | balance |
| Comp. Embodiment 2 | *7.0 | 1.5 | 0.1 | 0.3 | — | — | — | balance |
| Comp. Embodiment 3 | 5.0 | *0.1 | 0.1 | 0.3 | — | — | — | balance |
| Comp. Embodiment 4 | 5.0 | *2.5 | 0.1 | 0.3 | — | — | — | balance |
| Comp. Embodiment 5 | 5.0 | 1.0 | *— | 0.3 | — | — | — | balance |
| Comp. Embodiment 6 | 5.0 | 1.5 | 0.1 | *1.5 | — | — | — | balance |
| Test Embodiment 1 | 5.0 | 1.5 | 0.2 | — | — | — | 0.04 | balance |
| Comp. Embodiment 7 | 5.0 | 1.5 | 0.2 | — | — | — | *3.7 | balance |
| Test Embodiment 2 | 5.0 | 1.5 | 0.2 | 0.3 | — | — | 0.03 | balance |
| Comp. Embodiment 8 | 5.0 | 1.5 | 0.2 | 0.3 | — | — | *3.5 | balance |
| Test Embodiment 3 | 5.0 | 1.5 | 0.2 | 0.3 | 0.2 | — | 0.04 | balance |
| Comp. Embodiment 9 | 5.0 | 1.5 | 0.2 | 0.3 | 0.2 | — | *3.7 | balance |
| Test Embodiment 4 | 5.0 | 1.5 | 0.2 | 0.3 | 0.2 | 0.4 | 0.03 | balance |
| Comp. Embodiment 10 | 5.0 | 1.5 | 0.2 | 0.3 | 0.2 | 0.4 | *3.6 | balance |
| Comp. Embodiment 11 | *6.5 | 0.5 | 0.1 | 0.8 | — | — | — | balance |
| Test Embodiment 5 | 5.0 | 1.5 | 1.2 | 0.3 | — | — | — | balance |
| Comp. Embodiment 12 | 5.0 | 1.5 | *0.004 | 0.3 | — | — | — | balance |
| Comp. Embodiment 13 | 5.0 | *0.1 | 0.1 | 0.3 | 0.6 | — | — | balance |
| Test. Embodiment 6 | 5.0 | 1.0 | 1.2 | 0.3 | 0.6 | — | — | balance |
| Comp. Embodiment 14 | 5.0 | 1.0 | *0.004 | 0.3 | — | 0.6 | — | balance |

Casting crack is caused by stress concentration during the solidification shrinkage in the vicinity of the portion where the thickness of the casting 1 shown in FIG. 5(*a*) and FIG. 5(*b*) changes from 1 mm to 2 mm. With respect to samples of the respective alloys, casting of 100 shots was performed and the first 30 shots were scrapped. With respect to the remainder 70 shots, the average casting crack length per one shot was determined and casting crackability was evaluated by this casting crack length.

Die-sticking was visually observed.

Furthermore, plate-shaped test samples were cut from the portion having a thickness of 3 mm out of the casting, and then the tensile test and the creep test were performed.

The tensile test was performed at room temperature under the conditions of a cross head speed of 5 mm/minute using a 10-tons Instron-type testing machine.

The creep test was performed at a temperature of 150° C. under a load of 50 MPa for 100 hours, and then the minimum creep rate was determined from a creep curve and creep properties were evaluated by the minimum creep rate. The smaller the minimum creep rate, the better the creep properties.

In case salt water is sprayed over the sample for 240 hours, the measured corrosion weight loss is shown as an index of the corrosion resistance.

These results are shown in Table 3 and Table 4 below.

TABLE 3

| | Tensile strength | Proof stress | Elongation | Minimum creep rate | Casting crack length | Die-Sticking | Corrosion resistance Corrosion weight loss |
|---|---|---|---|---|---|---|---|
| Embodiment 1 | 92 | 85 | 7.8 | 5.6 | 42 | none | 76 |
| Embodiment 2 | 116 | 102 | 8.2 | 64 | 32 | none | 52 |
| Embodiment 3 | 163 | 138 | 2.2 | 21 | 6 | none | 36 |
| Embodiment 4 | 193 | 134 | 6.3 | 59 | 0.1 | none | 82 |
| Embodiment 5 | 196 | 150 | 4.3 | 1.1 | 2.2 | none | 8 |
| Embodiment 5 | 183 | 147 | 3.6 | 6.1 | 0 | none | 38 |
| Embodiment 7 | 162 | 147 | 2.0 | 0.9 | 0.8 | none | 12 |
| Embodiment 8 | 205 | 152 | 5.2 | 60 | 0.5 | none | 21 |
| Embodiment 9 | 172 | 141 | 3.7 | 6.3 | 0 | none | 24 |
| Embodiment 10 | 202 | 159 | 3.1 | 7.1 | 0 | none | 19 |
| Embodiment 11 | 124 | 90 | 8.0 | 73 | 30 | none | 94 |
| Embodiment 12 | 89 | 81 | 7.0 | 81 | 61 | none | 39 |
| Embodiment 13 | 195 | 130 | 6.7 | 69 | 8 | none | 97 |
| Embodiment 14 | 204 | 131 | 5.9 | 82 | 19 | none | 91 |
| Embodiment 15 | 160 | 139 | 1.6 | 4.0 | 3 | none | 21 |
| Embodiment 16 | 163 | 149 | 1.8 | 3.0 | 1 | none | 24 |
| Embodiment 17 | 190 | 150 | 3.2 | 5.9 | 0 | none | 30 |
| Embodiment 18 | 185 | 160 | 2.0 | 0.8 | 4 | none | 19 |
| Embodiment 19 | 181 | 155 | 1.1 | 0.7 | 10 | none | 14 |
| Embodiment 20 | 174 | 143 | 3.2 | 5.2 | 0 | none | 16 |
| Embodiment 21 | 181 | 152 | 0.9 | 1.6 | 16 | none | 13 |
| Embodiment 22 | 176 | 142 | 3.0 | 6.8 | 6 | none | 14 |
| Embodiment 23 | 179 | 150 | 1.6 | 3.4 | 17 | none | 21 |
| Embodiment 24 | 215 | 165 | 5.4 | 3.6 | 0 | none | 35 |
| Embodiment 25 | 225 | 166 | 5.8 | 3.2 | 0 | none | 38 |
| Embodiment 26 | 202 | 142 | 4.8 | 74 | 0.5 | none | 47 |
| Embodiment 27 | 189 | 152 | 1.4 | 0.9 | 11 | none | 18 |
| Embodiment 28 | 206 | 162 | 2.0 | 0.6 | 5.6 | none | 17 |
| Embodiment 29 | 196 | 137 | 6.2 | 2.1 | 0 | none | 18 |
| Embodiment 30 | 190 | 161 | 1.2 | 0.6 | 7 | none | 12 |
| Embodiment 31 | 188 | 159 | 0.9 | 0.7 | 12 | none | 18 |
| Embodiment 32 | 168 | 150 | 2.8 | 0.9 | 0.5 | none | 10 |
| Embodiment 33 | 143 | 131 | 7.2 | 5.6 | 5 | none | 34 |

TABLE 4

| | Tensile strength | Proof stress | Elongation | Minimum creep rate | Casting crack length | Die-sticking | Corrosion resistance Corrosion weight loss |
|---|---|---|---|---|---|---|---|
| Comp. Embodiment 1 | 82 | 69 | 8.2 | 450 | 67 | observed | 810 |
| Comp. Embodiment 2 | 210 | 125 | 6.2 | 630 | 0 | none | 15 |
| Comp. Embodiment 3 | 198 | 122 | 8.0 | 165 | 0 | none | 550 |
| Comp. Embodiment 4 | 142 | 132 | 1.1 | 6.2 | 630 | observed | 210 |
| Comp. Embodiment 5 | 154 | 139 | 1.4 | 46 | 72 | none | 40 |
| Comp. Embodiment 6 | 109 | 93 | 0.4 | 72 | 1.2 | none | 14 |
| Test Embodiment 1 | 233 | 135 | 8.0 | 75 | 7.1 | none | 140 |
| Comp. Embodiment 7 | 172 | 151 | 0.7 | 0.9 | 32 | observed | 120 |
| Test Embodiment 2 | 160 | 143 | 2.8 | 1.1 | 2 | none | 16 |
| Comp. Embodiment 8 | 170 | 151 | 0.5 | 0.9 | 48 | observed | 27 |
| Test Embodiment 3 | 171 | 141 | 2.9 | 5.6 | 1 | none | 21 |
| Comp. Embodiment 9 | 180 | 154 | 0.6 | 2.1 | 21 | observed | 29 |
| Test Embodiment 4 | 172 | 148 | 3.8 | 7.2 | 9 | none | 24 |
| Comp. Embodiment 10 | 181 | 152 | 2.4 | 3.9 | 24 | observed | 31 |
| Comp. Embodiment 11 | 212 | 128 | 7.2 | 521 | 0 | none | 52 |

TABLE 4-continued

| | Tensile strength | Proof stress | Elongation | Minimum creep rate | Casting crack length | Die-sticking | Corrosion resistance Corrosion weight loss |
|---|---|---|---|---|---|---|---|
| Test Embodiment 5 | 194 | 138 | 6.2 | 5.2 | 0 | none | 99 |
| Comp. Embodiment 12 | 139 | 132 | 0.9 | 40 | 110 | none | 32 |
| Comp. Embodiment 13 | 204 | 131 | 6.9 | 105 | 0 | none | 560 |
| Test. Embodiment 6 | 206 | 161 | 6.1 | 3.8 | 0 | none | 120 |
| Comp. Embodiment 14 | 160 | 140 | 1.6 | 58 | 92 | none | 54 |

*In Table 3, Embodiments 1 to 33 correspond to the test results of the samples obtained from the alloys of Embodiments 1 to 33 in Table 1.

*In Table 4, Comparative Embodiments 1 to 14 correspond to the test results of the samples obtained from the alloys of Comparative Embodiments 1 to 14 in Table 2.

*In Table 4, Test Embodiments 1 to 6 correspond to the test results of the samples obtained from the alloys of Test Embodiments 1 to 6 in Table 2.

*In Table 3 and Table 4, the unit of the tensile strength and proof stress is MPa, the unit of the elongation is %, the unit of the minimum creep rate is $10^{-9}$/s, the unit of the casting crack length is mm, and the unit of the corrosion weight loss is mg/cm$^2$/240 hours, respectively.

As is apparent from the results shown in Table 1 to Table 4, the alloy with the composition within the range of the present invention makes it possible to produce a die casting alloy which has excellent tensile strength and proof stress and exhibits small minimum creep rate and short casting crack length, and which has excellent corrosion resistance (small corrosion weight loss) and does not cause die-sticking during the casting.

The sample of Comparative Embodiment 1 is a sample containing Al in the amount of 1.0% by weight smaller than 2% by weight as the lower limit of the range of the present invention, and it exhibited large minimum creep rate and large casting crack length and caused die-sticking and decrease in tensile strength, and also exhibited large corrosion weight loss.

The sample of Comparative Embodiment 2 is a sample containing Al incorporated therein in the amount of 7.0% by weight with greater than 6% by weight as the upper limit of the range of the present invention, and the minimum creep rate increased.

The sample of Comparative Embodiment 3 is a sample containing Ca in the amount of 0.1% by weight with less than 0.3% by weight as the lower limit of the range of the present invention, and the minimum creep rate increased, while the sample of Comparative Embodiment 4 is a sample containing Ca in the amount of 2.5% by weight with greater than 2% by weight as the upper limit of the range of the present invention, and the casting crack length drastically increased and die-sticking also occurred.

The sample of Comparative Embodiment 5 is a Sr-free sample, and it exhibited large minimum creep rate and large casting crack length, while the sample of Comparative Embodiment 6 is a sample containing Mn in the amount of 1.5% by weight with greater than 1.0% by weight within the range of the present invention, and the proof stress decreased and the minimum creep rate increased.

The samples of Comparative Embodiments 7, 8, 9, and 10 are samples wherein the amount of rare earth elements exceeds 3% by weight and any of Mn, Si and Zn is added or the addition of any one of them is omitted, and they exhibited excellent creep properties, but the casting crack lengths light increased and die-sticking also occurred.

The sample of Comparative Embodiment 12 is a sample containing Sr in an amount less than the lower limit of the range of the present invention, and the minimum creep rate was slightly large and the casting crack length increased.

Comparative Embodiments 13 show the measurement results of the sample containing Ca in the amount less than the lower limit in the state where Si is contained, while Comparative Embodiments 14 show the measurement results of the sample containing Sr in the amount smaller than the lower limit in the state where Zn is contained. The samples of Comparative Embodiments 13 exhibited slight large minimum creep rate, the sample of Comparative Embodiment 14 exhibited slight large minimum creep rate and large casting crack length.

As is apparent from the above description, the alloys (comparative embodiments) with the composition departing from that of the present invention are inferior in any of tensile strength, proof stress, elongation, creep properties, casting crack length, die-sticking, and corrosion resistance to the alloys with the composition of the embodiments.

What is claimed is:

1. A die casting magnesium alloy having excellent heat resistance, excellent creep properties and castability, consisting of 2 to 6% by weight of Al, 0.3 to 2% by weight of Ca, 0.2 exclusive to 1% by weight of Sr, 0.1 to 1% by weight of Mn, 0.2 to 1% by weight of Zn, and the balance being magnesium and unavoidable impurities, wherein the alloy has a tensile strength in a range of from 89 to 225 MPa.

2. A die casting magnesium alloy having excellent heat resistance, excellent creep properties and castability, consisting of 2 to 6% by weight of Al, 0.3 to 2% by weight of Ca, 0.2 exclusive to 1% by weight of Sr, 0.1 to 1% by weight of Mn, 0.1 to 1% by weight of Si, 0.2 to 1% by weight of Zn, and the balance being magnesium and unavoidable impurities, wherein the alloy has a tensile strength in a range of from 89 to 225 MPa.

3. A structural member around an engine made of a die casting magnesium alloy having excellent heat resistance, excellent creep properties and castability, consisting of 2 to 6% by weight of Al, 0.3 to 2% by weight of Ca, 0.2 exclusive to 1% by weight of Sr, 0.1 to 1% by weight of Mn, 0.2 to 1% by weight of Zn, and the balance being magnesium and unavoidable impurities, wherein the alloy has a tensile strength in a range of from 89 to 225 MPa.

4. A structural member around an engine made of a die casting magnesium alloy having excellent heat resistance, excellent creep properties and castability, consisting of 2 to 6% by weight of Al, 0.3 to 2% by weight of Ca, 0.2 exclusive to 1% by weight of Sr, 0.1 to 1% by weight of Mn, 0.1 to 1% by weight of Si, 0.2 to 1% by weight of Zn, and the balance being magnesium and unavoidable impurities, wherein the alloy has a tensile strength in a range of from 89 to 225 MPa.

* * * * *